United States Patent [19]

Vermot-Gaud et al.

[11] Patent Number: 5,001,496

[45] Date of Patent: Mar. 19, 1991

[54] METHOD FOR PROPELLING DROPLETS OF A CONDUCTIVE LIQUID

[75] Inventors: Jacques Vermot-Gaud, Perly; Didier Joyeux, Petit-Lancy, both of Switzerland

[73] Assignee: Battelle Memorial Institute, Carouge, Switzerland

[21] Appl. No.: 415,913

[22] Filed: Oct. 2, 1989

[30] Foreign Application Priority Data

Oct. 5, 1988 [CH] Switzerland ..... 3705/88

[51] Int. Cl.[5] ..... B41J 2/06

[52] U.S. Cl. ..... 346/1.1; 346/140 R

[58] Field of Search ..... 346/1.1, 140

[56] References Cited

U.S. PATENT DOCUMENTS

| | | | |
|---|---|---|---|
| 4,126,867 | 11/1978 | Stevenson . | |
| 4,432,003 | 2/1984 | Barbaro | 346/140 |
| 4,502,054 | 2/1985 | Brescia | 346/140 X |
| 4,575,737 | 3/1986 | Vermot-Gaud | 346/140 |
| 4,746,937 | 5/1988 | Realis Luc et al. . | |

FOREIGN PATENT DOCUMENTS 106802 4/1984 European Pat. Off. .

*Primary Examiner*—Joseph W. Hartary

*Attorney, Agent, or Firm*—Cushman, Darby & Cushman

[57] ABSTRACT

A pulse of current of several hundreds of volts is established between two electrodes immersed in a resistive liquid. By concentration of the current at the end of one electrode, which is bonded onto an insulating support, a volume of liquid in contact with the end of this electrode is vaporised, causing an abrupt drop in current. Because of the voltage of the pulse, which is several hundred volts, a greater current re-establishes itself immediately across the volume of vaporised liquid, as a result of a sort of ionization of the vapor, causing superheating and energy sufficient to expel a droplet of liquid through an opening provided in a membrane. In order to limit the energy of the superheating phase and control the size of the droplets, the current of the energizing pulse is limited.

20 Claims, 3 Drawing Sheets

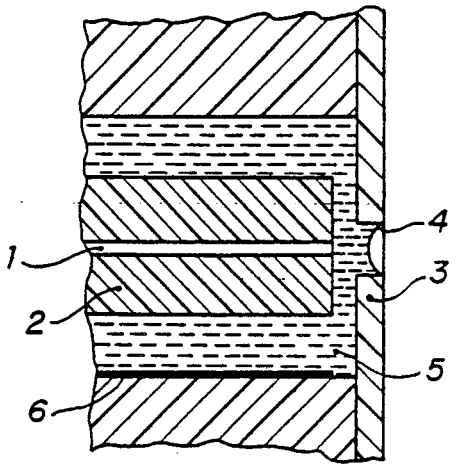
FIG. 1
FIG. 2a
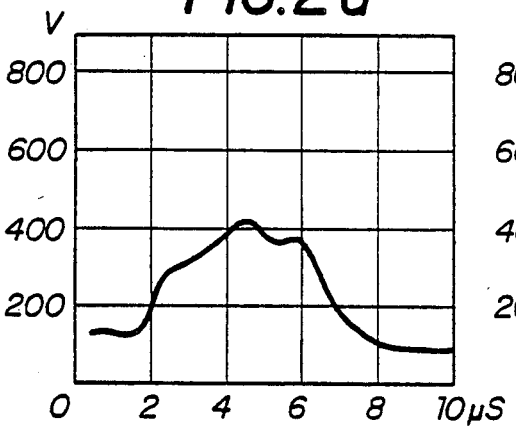
FIG. 3a
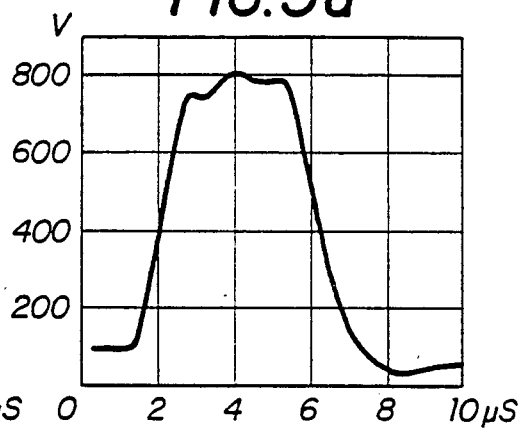
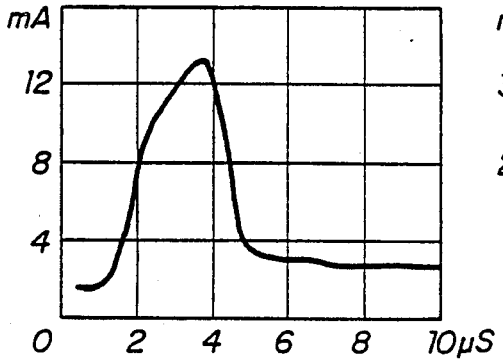
FIG. 2b
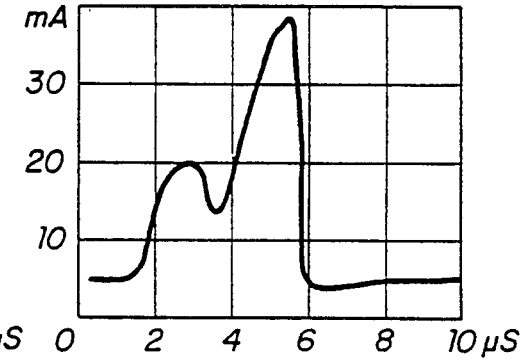
FIG. 3b

METHOD FOR PROPELLING DROPLETS OF A CONDUCTIVE LIQUID

BACKGROUND OF THE INVENTION

1. Field of the invention

The present invention relates to a method for propelling droplets of an electrically conductive liquid according to which the end of a first electrode whose cross-section is approximately of the order of size of that of the droplets is disposed in this liquid, this end being flush with an insulated support surrounded by the said liquid a second electrode, a surface of which is substantially greater than that of the said end of the first electrode, is disposed in this liquid in contact with it, and these two electrodes are connected to the terminals of a pulse generator to cause resistive heating of the liquid in the immediate proximity of the said end, suitable for vaporising a quantity of the said liquid capable of producing a force able to propel a droplet of this liquid.

2. Description of the prior art

A structure capable of effecting such a method is described in European Patent Specification No. B1 0,106,802. Study of the manner of energising such a structure has s the results and the efficiency vary appreciably depending on the mode of energisation chosen. Thus, in French Patent Specification No. 2,092,577 it has been proposed to connect two electrodes submerged in liquid ink to a high voltage source to form a discharge circuit in such a manner as to create a spark which generates an over-pressure within the liquid, causing it to be ejected through an opening. Such a mode of energisation has disadvantages linked to the use of a high voltage source, the principal disadvantage arising however from the poor efficiency resulting from this mode of propulsion of liquid droplets.

The use of much lower voltages has shown that it is also possible to propel droplets of liquid by generating within the mass of liquid a force resulting from the vaporising of a volume of liquid in the neighbourhood of the end of an electrode aligned with the surface of an insulating support surrounded by the liquid droplets of which are to be propelled. Detailed study of the phenomenon has shown, on the basis of measurements that there exists a range of voltages for which an appropriate volume of liquid is vaporised. However, the vaporisation alone of this liquid in accordance with Ohms law is not sufficient to produce the propulsion energy necessary for the droplet. It has been remarked, however, that if the voltage is sufficient, as soon as the current tends to break-off, it is quickly re-established as a result of what may be interpreted as a sort of ionisation of the liquid vapour.

While this mode of propulsion shows itself to be effective and relatively efficient compared to other modes of propulsion of droplets on demand, used in particular in ink jet printing systems poor reproducibility of that phase of the process of propulsion which may be termed "ionisation" has also been noticed which shows as a great variation in the size of the droplets, from being equal to at least double, between the projection of two successive droplets. It is very evident that such a variation is not desirable, in particular when these droplets are intended to form characters in an ink jet printing system.

It has already been proposed in U.S. Pat. Specification No. 4,746,937 to limit the energy in a very different ink jet system, in which the conductive ink is disposed in a long tube and fulfills the role of a heating resistance. In this ink jet, a volume of ink corresponding to several tens of times the volume of ink to be expelled is heated in such a way that if the heating conditions are kept constant, a stage is arrived at where the total volume of the tube is emptied as a result of constant increase in the temperature of the ink contained in this tube. It is for this reason that it has been proposed to control the duration of the ink preheating pulse in such a manner that it is inversely proportional to the initial temperature of the ink. This solution is of no great interest when the volume of ink heated is more or less equal to that expelled, such that the following volume of ink is more or less at ambient temperature. Thus this solution does not tackle the problem which concerns us.

It has also been proposed in U.S. Pat. Specification No. 4,126,867 to limit the polarising voltage of the base of an amplifying transistor whose emitter is connected to a piezo-electric motor element, but this does not advantageously tackle the problem which concerns us.

BRIEF SUMMARY OF THE INVENTION

It is an object of the present invention to overcome at least in part the above-mentioned disadvantages.

Accordingly, the present invention has as a subject a method for propelling droplets of an electrically conductive liquid according to which the end of at least a first electrode whose cross-section is approximately of the order of size of the droplets is disposed in the liquid, said end being flush with an insulating support surrounded by the said liquid, a second electrode a surface of which is substantially greater than that of said end of the first electrode is disposed in the liquid in contact with it, and these two electrodes are connected to the terminals of a pulse generator for causing resistive heating of the liquid in the immediate proximity of said end, for vaporising a quantity of said liquid capable of producing a force able to propel a droplet of the liquid, wherein once said quantity of liquid has been vaporised, tending to cause a break in the current the voltage is fixed at a value capable of ionizing the vapour of said quantity of vaporised liquid and simultaneously the current crossing said quantity of vaporised liquid is limited below a predetermined threshold, to produce within the mass of said quantity a controlled superheating energy.

Trials carried out using this method have shown that it enables the size of the propelled droplets to be controlled within limits, sufficient in particular for the needs of a printer.

BRIEF DESCRIPTION OF THE DRAWINGS

The accompanying drawings illustrate diagrammatically and by way of example, an embodiment and variants of a device for effecting the method which is a subject of the present invention, and also its energising circuit.

FIG. 1 is sectional view of a device for effecting this method.

FIGS. 2 and 3 are two voltage current diagrams as a function of time between the electrodes.

DETAILED DESCRIPTION OF THE DRAWINGS

Figure 4:
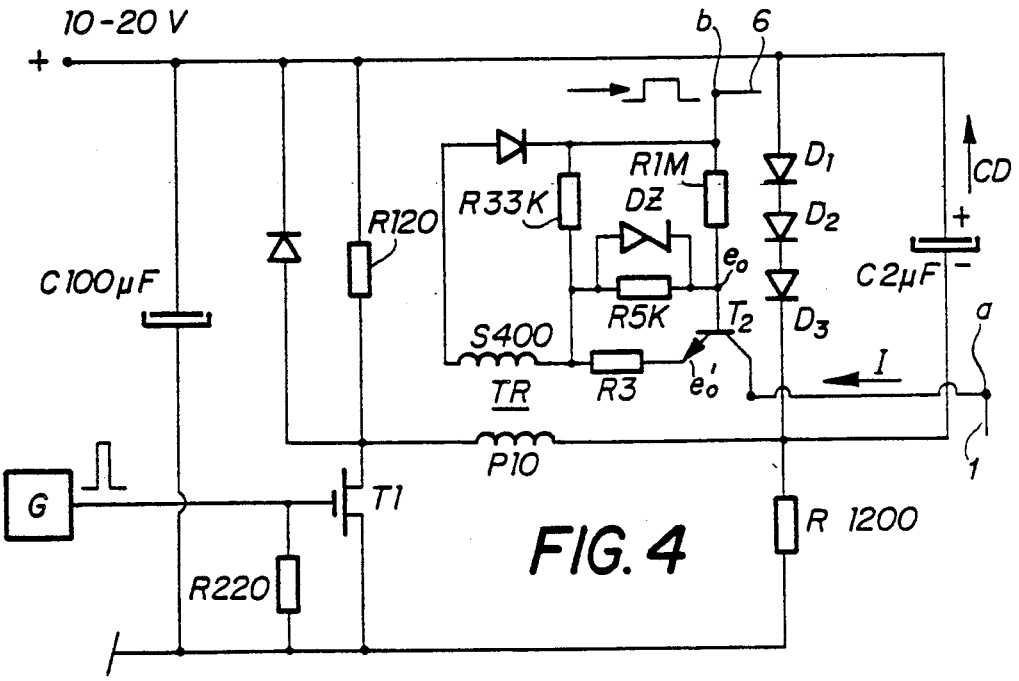
FIG. 4 is a schematic of an energising circuit for the device of FIG. 1.

The device illustrated in FIG. 1 corresponds to that which is described and illustrated in European Patent Specification No. B1 0,106,802, which may be advantageously referred to for further details. This device comprises a first electrode 1 formed by a thin wire of a metal which is a good conductor of electricity and is corrosion resistant, bonded onto an insulating support 2. The end of this electrode 1 is flush with the surface of this support 2. A membrane 3, which may be metallic, is pierced by an opening 4. disposed co-axially with the electrode 1, and serving for the projection of droplets of a liquid 5, which fills the space between the membrane 3 and the insulating support 2, this space forming the reservoir for the liquid. A second electrode 6, whose surface in contact with the liquid is appreciably greater than that of the end of the electrode 1, is disposed somewhere in the volume of liquid 5.

By way of example, tests have been carried out with a membrane 3 40 μm to 50 μm thick, the opening 4 having a diameter of to 1 the membrane 3 being μm from the support 2, and the electrode 1 being formed by a wire of stainless steel or platinum 20 μm to 25 μm to diameter. Copper is also of interest as a metal for the electrode, in particular in regard to its resistance to electro-erosion. Other dimensions and different materials have been used and also the electrode 1 has been placed at a positive or negative polarity, thus changing the direction of the current. Taking into consideration the fact that the conductive ink behaves as an electrolyte if the polarity of the electrode 1 is positive it receives oxygen and is thus subjected to a high risk of corrosion. In the opposite case, the electrode 1 becomes the cathode, and it receives hydrogen or metal. These tests have been carried out with inks whose resistivity is between 40 ohm-cm and 560 ohm-cm, and the supply voltage at the electrodes was between 100 and 700 volts.

When the voltage is relatively low, that is to say in the above-mentioned conditions, of the order of 100 V, a reduction in the current is noticed, as is shown by the curve of the of FIG. 2*b*. This drop in the current should correspond to the vaporisation of the ink in contact with the end of the electrode 1. The energy produced by this purely resistive heating phase is insufficient to cause the ejection of a droplet of the liquid. Furthermore, the change of phase of the liquid in proximity to the end of the electrode 1 explains the fall-off in current measured.

When the supply voltage at the electrodes 1 and 6 is increased, after a fall-off in the current (FIG. 3*b*), a sudden increase in the current is seen to appear, accompanied by a more or less stable voltage (FIG. 3*a*) tending to reduce. This phenomenon, which was observed in a consistent manner, does not obey in any way Ohms law and may be likened to a current resulting from a sort of ionisation of the liquid vapour. The observations taken during numerous tests have enabled it to be confirmed that this second phase, which causes a superheating as a result of the establishment of an ionic current, seems absolutely indispensable for obtaining the energy capable of causing the projection of a droplet of liquid.

Amongst all the many parameters intervening in the process of projection of droplets the superheating phase obtained on account of an increase in current is that which influences to the greatest extent the result obtained. However, this current is strongly dependent on the level of ionisation, such that the corresponding energy may be very variable. Consequently, the formation and the dimension of the droplets may also vary in the same proportions, which constitutes an important disadvantage in this method of projection of droplets, consistency obviously being a quality factor, in particular in the context of a printing process.

It is precisely the solving of this problem that the invention has as an object, by limiting the current and as a consequence the energy during this second phase of the process of projection of droplets, so as to stabilise the formation of the droplets, reduce their size and maintain consistency of size.

FIG. 4 illustrates the circuit of the electrical pulse generator used to produce the short voltage pulses of a duration of to 5 10 microseconds and at a voltage preferably between 400 and 600 volts. The resistivity of the ink is chosen preferably between 400 and 800 ohm-cm. Below this limit, the electrochemical current would be increased and as a consequence the production of gas bubbles, while above this limit, the voltage of the electrical pulses would be increased.

To produce the pulses from a low voltage source of 10 to 20 volts, this circuit comprises a step-up transformer TR in which the ratio between the secondary S400 and the primary P10 is here 40, that is, 400 turns for the secondary and 10 for the primary.

The primary P10 of this transformer is supplied with pulses by a generator G, which delivers pulses of the desired duration, here of 5 to 10 μs, to the base of a field effect transistor TI.

With a view to making the transformer work with symmetrical pulses in regard to the product of voltage x time the supply circuit for the primary P10 of the transformer TR has three diodes in series, D1, D2, D3, with a resistance R1200 and a capacitor C2μF. These diodes in series with the resistance R1200 produce a polarisation of about 1.5 volt stored in the capacitor C2μF. When a pulse from the generator G amplified by the transistor T1 terminates, the capacitor C2μF discharges with a current of opposite direction directed in the direction arrow CD, which passes through the resistance R120 and repolarises the transformer TR for the next pulse from the generator G.

To make the current at the terminals of the secondary S400 independent of the charge in the ionised liquid vapour, which may be very variable, as previously explained. a current limiting circuit is associated with the secondary S400.

The part of this circuit comprising a resistance RIM in series with a resistance R5K in parallel with a Zener diode is connected to the base of a transistor T2. The electrodes 1 and 6 of FIG. 1 are connected respectively to the points a and b of the circuit of FIG. 4, in such a way that the electrode 1 is negative with respect to the ink and the current I goes from the ink towards the electrode 1 in the direction of the arrow of FIG. 4. This enables electrochemical corrosion of the electrode 1 to be avoided. Because of the Zener diode, the polarising voltage $e_o$ of the transistor T2 is maintained constant. Its emitter is thus at a potential $e_o$ corresponding to the voltage $e_o$ less the voltage of the transistor, which is here 0.2V. The voltage $e_o$ corresponds to:

$$e'_o \times R_3 \cdot I$$

then, $$e'_o = R_3 \cdot I$$

$$I = \frac{e'_o}{R_3} = \frac{e_o - 0.2}{R_3}$$

By suitably choosing the value of $e_o$, which is given by the Zener diode DZ, and the value of the resistance R3, a constant current $I_o$ is obtained. For example with:

$e_o \times 1.2$ volts $R_3 \times 100$ ohms $I_o \times 10$ mA the same current 10 mA, may be obtained with $e_o = 10.2$ volts and R3 = 1000 ohms. Because of limitation of the supply current to the electrodes 1 and 6, the energy W in the discharge is limited to a fixed value:

$$W = \int_o^T vidt$$

v = ionising voltage $-3V_o$ $$W = V_o \int_o^T idt$$

If precise definition of the energy is desired a circuit supplying, a priori, a voltage greater than $V_o$ must be used, for example $V_o + 50$ or 100 volts, and the circuit described above placed in series with the source giving this voltage, limiting the current to a fixed value $I_o$, such that $$W \times V_o I_o T$$

Another solution giving a less precise result but one which may be sufficient, would consist of using a series impedance, for example a resistance equal to the resistance of the electrode 1.

The circuit of FIG. 4 was tested with success by limiting the value of the current $I_o$ to 30 mA. Accordingly comparative tests with and without current limitation were carried out. On the one hand, the energy of the phase 2 of superheating producing the projection of the droplets was measured and the diameter of the droplets obtained was also measured. The tests were carried out with a device comprising an electrode 1 of μm diameter, of platinum, and having an opening 4 of 80 μm diameter and length. The table below indicates the results obtained in the two cases.

| | Superheating Energy (microjoules) | dimension of droplets (μm) |
|---|---|---|
| with current limitation | 30 | 100–120 |
| without current limitation | 30–80 | 100–200 |

These results show clearly that the limitation of superheating energy corresponding to the second phase of the process of projection of the droplets enables good consistency in the size of the droplets to be obtained, while without this limitation, this size varies from being equal to double. It is evident, in particular in the case of a demand ink jet on a printing device, that this control of the size of the droplets constitutes an essential quality factor. Of course, a number of other parameters intervene in the process of formation of the droplets. However, these parameters do not have a marked influence on the consistency of the size of the droplets. As a consequence, these other parameters intervene above all in the initial choice at the time of conception of the projection device. On the other hand, and whatever the parameters adopted may be, the instability of the process of projection intervenes and is inherent in this process, as long as the energy of the superheating phase of the liquid vapour is not limited. It thus follows that in the context of the droplet propulsion process described, this limitation is a determining element for consistency, inherent in the fact that only the superheating phase of the liquid vapour is capable of producing sufficient energy to project the droplets, but that the current in this medium in the vapour phase is extremely variable from one moment to another, generating energy levels liable to vary in an approximate ratio of 1 to 3.

Obviously other means exist for limiting or defining the energy during the drive pulse for a droplet. Thus, an intermediate energy storage element such as a capacitor or an inductance may be used.

Figure 5:
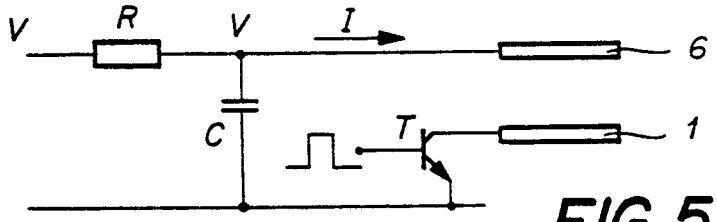
FIGS. 5 and 6 are two schematics of two variants of the circuit of FIG. 4.

A circuit enabling the energy delivered to be limited or defined by means of a capacitor C is illustrated in FIG. 5. A resistance R is chosen so that the capacitor C is charged slowly to a selected voltage V greater than the ionisation voltage $V_o$. While the transistor T conducts, the capacitor C discharges into the conductive liquid to be propelled between the electrodes 1 and 6, at a current level I, until the moment when the voltage becomes less than the ionisation voltage $V_o$. At that moment, the transistor T ceases to conduct and the current I is interrupted. The energy delivered is thus equal to $$\tfrac{1}{2}C\,(V^2 - V_o^2)$$

Figure 6:
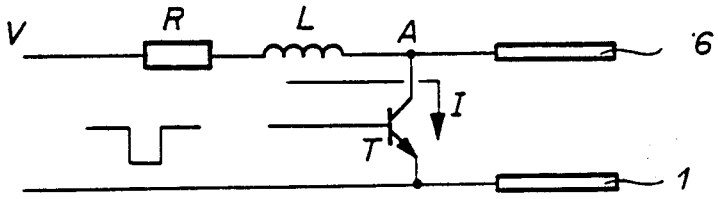

FIG. 6 illustrates the case of a circuit using an inductance L to limit the energy delivered. It is to be noted however that this second solution is more difficult and more expensive than the preceding, as it requires a very great inductance L of the order of 100 mhenry while the circuit of FIG. 5 only requires a very small capacitor C of the order of 100 picofarad.

Between the drive pulses for the droplets, the transistor T conducts and a current I = V/R is established in the inductance L. To produce a pulse capale of propelling a droplet of liquid through the opening 4, the transistor T is then cut-off, causing at the point A of the circuit an increase in voltage sufficient to re-establish the current across the vaporised liquid because of the ionisation. The discharge current of the inductance L continues μntil all the stored energy disappears. The energy supplied thus corresponds to: $-\frac{1}{2}L\,I^2$.

The process according to the invention has been described in relation to the energising of a single electrode 1 for propelling droplets. In practice, the membrane will comprise several openings 4 side by side and the insulating support several electrodes 1.

By definition, the ink is equipotential with respect to the electrodes 1 and 6. Preferably, the membrane 5 is electrically conductive, being for example formed by a sheet of copper which also serves as a counter-electrode 6. This arrangement enables interference between neighbouring propelling devices to be avoided, which are spaced in this example at 250 μm from axis to axis, and in particular it enables obstruction of the passage of current in the case of formation of bubbles on an electrode 1 to be avoided. By locating the counter-electrode opposite the electrodes 1, these bubbles do not obstruct the flow of the current between the neighbouring electrodes and the counter-electrode.

There exists in this case two possibilities for selectively energising the electrodes 1, either by using a common source of high voltage pulses for a series of electrodes, or by using one pulse source per electrode.

Figure 7:
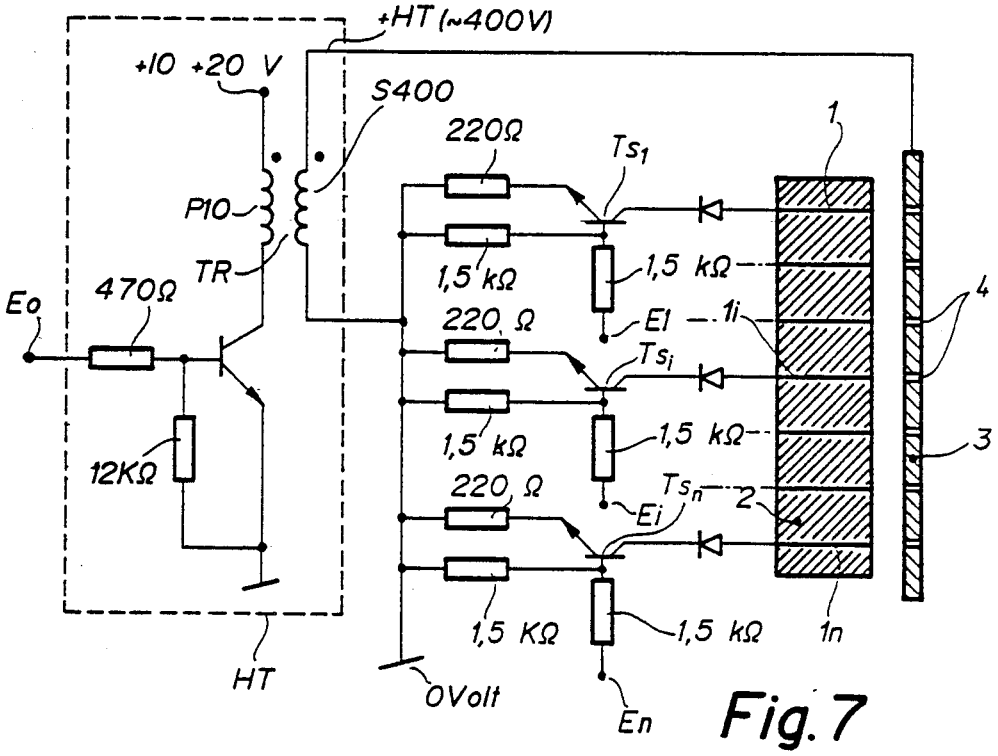
FIGS. 7 and 8 are two schematics of energising circuits for a series of drive electrodes.

In the schematic of FIG. 7, there may be noted the insulating support 2, the electrodes 1 to 1*n*, and the membrane 3 with the openings 4 disposed opposite the electrodes 1 to 1*n*. On the actual electrical schematic, there is a high voltage source HT with the primary P10 and the secondary S400 of the transformer TR supplying the high voltage pulses of ≃400 volts. Each electrode 1 to 1*n* is associated with a selector comprising a selection transistor $TS_1$ to $TS_n$ whose base is selectively polarised by the logic of the printer (not shown) by voltage signals $E_I$ to $E_n$. These transistors are provided with current limitation by virtue of a resistance of 220 ohms for example placed in series with the emitter. The current is thus limited to $$(E_i - V_{be}) / 220$$

$$(5-1) / 220 \simeq 18\text{mA}$$

($V_{be}$: base-emitter voltage of the transistor).

The selectors thus play a double role, actual selection and limitation of current and therefore of energy.

The ink and the membrane 3 must be at a positive potential with respect to the electrodes 1 to 1n to ensure that the direction of the current is such that it enters these electrodes from the ink in such a manner that the potential of ≃400 volts is applied to the membrane 3 while the electrode selectors are connected to a 0 V reference potential.

Figure 8:
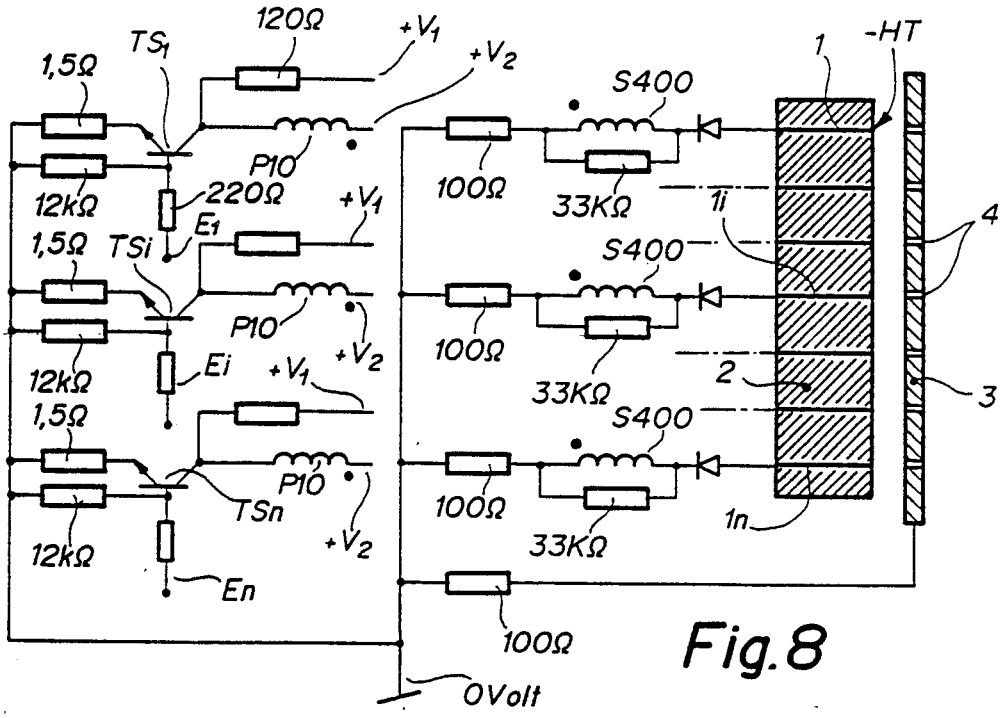

In the variant of FIG. 8, each electrode 1 to 1n is energised by the secondary 400 of an independent transformer supplying a pulse of volts to the electrode. The reference point of each secondary is connected to a 0 volt potential, as is the membrane 3 which plays the role of counter-electrode.

Each pulse carries the potential of the electrode or the electrodes selected at −HT (≃400 volts) to ensure the direction of the current from the ink to the electrode, the counter electrode being at the 0 volt potential.

The selection transistors $TS_1$ to $TS_n$ are arranged in series with the primary P10 of each transformer. The base of each transistor is selectively polarised by the logic of the printer by voltage signals E1 to $E_n$. These transistors are provided with current limitation by virtue of the resistance of 1.5 ohms in series with the emitter. In this way, the current at the secondary S400 and as a consequence that on the electrode is likewise limited. The leakage self-inductance of the transformers also produces a dynamic limitation of the electrode current.

What is claimed is:

1. A method for propelling droplets of an electrically conductive liquid, comprising the steps of:

disposing an end of at least a first electrode whose cross-section is approximately of the order of size of the droplets in the liquid, said end being flush with an insulating support surrounded by said liquid;

disposing a second electrode, a surface of which is substantially greater than that of said end of the first electrode, in the liquid in contact with it;

connecting these two electrodes to terminals of a pulse generator;

energizing said pulse generator to resistive heat the liquid in the immediate proximity of said end, for vaporizing a quantity of said liquid capable of producing a force able to propel a droplet of the liquid, once said quantity of liquid has been vaporized, fixing the voltage at a value capable of ionizing the vapor of said quantity of vaporized liquid and simultaneously limiting the current crossing said quantity of vaporized liquid below a predetermined threshold independent of the charge in said ionized vaporized liquid, to produce within the mass of said quantity a controlled superheating energy.

2. A method according to claim 1 wherein the voltage of the energising pulse is chosen above the ionizing voltage of the vapour of the said liquid to automatically bring about this ionization after the drop in the current resulting from the vaporisation of said quantity of liquid.

3. A method according to claim 1 wherein in order to limit the current of the energising pulse, a constant voltage is set on the base of a transistor and a resistance is placed in series with its emitter, whose value is chosen so that the current appearing at the collector and which corresponds to the quotient of the voltage of the emitter by this resistance, does not exceed a predetermined value.

4. A method according to claim 3, wherein the base of the transistor is connected between two resistances in series connecting the two terminals of the pulse source, and that a Zener diode is disposed in parallel with the resistance, which goes from the base of the transistor to the negative terminal of the said source.

5. A method according to claim 3, wherein in the electrically conductive liquid a plurality of said first electrodes are disposed and further comprising the step of energizing these electrodes by high voltage pulses from a common source and by control signals caused to appear at the base of a selection transistor provided for current limitation with said common source.

6. A method according to claim 5, wherein an electrically conductive membrane is disposed opposite the respective ends of said first electrodes disposed in the electrically conductive liquid, said membrane having an opening opposite each of said ends, and said membrane is connected to one of the terminals of said pulse generator.

7. A method according to claim 3, wherein in the electrically conductive liquid a plurality of said first electrodes are disposed and each is energised with high voltage pulses by the secondary of a transformer, a selection transistor is provided in series with each primary, on the base of which control signals are caused to appear, and each of said transistors is provided for current limitation.

8. A method according to claim 7, wherein an electrically conductive membrane is disposed opposite the respective ends of said first electrodes disposed in the electrically conductive liquid, said membrane having an opening opposite each of said ends, and said membrane being connected to one of the terminals of said pulse generator.

9. A method according to claim 1, wherein in order to limit the energy of the energising pulse, a capacitor is disposed between the first and the second electrode, the discharge of this capacitor is controlled by means of a transistor whose conduction threshold is fixed above the ionization voltage of said vapour and the charging of the capacitor is controlled by means of a resistance.

10. A method according to claim 1, wherein in order to limit the energy of the energising pulse, an inductance is placed in series with a transistor disposed between the two electrodes said transistor is closed to charge the inductance between energising pulses, then, at the moment of a pulse said transistor is cut-off to increase the voltage at the output of the inductance to a value greater than the ionization voltage of said quantity of vaporised liquid, permitting the current to re-establish itself and the inductance to discharge.

11. A method according to claim 1, wherein the direction of flow of the current is chosen in such a manner that it flows from said second electrode towards said first electrode across said electrically conductive liquid.

12. An apparatus for propelling droplets of an electrically conductive liquid, comprising:

a first electrode whose cross-section is approximately of the order of size of the droplets, having an end which is disposed in the liquid;

an insulating support with which said end is flush, surrounded by said liquid;

a second electrode, a surface of which is substantially greater than that of said end of the first electrode, disposed in the liquid in contact with it;

a pulse generator, having terminals to which said electrodes are connected for energizing to resistively heat the liquid in the immediate proximity of said end, for vaporizing a quantity of said liquid capable of producing a force able to propel a droplet of the liquid;

means for, once said quantity of liquid has been vaporized, fixing the voltage at a value capable of ionizing the vapor of said quantity of vaporized liquid and simultaneously limiting the current crossing said quantity of vaporized liquid below a predetermined threshold independent of the charge in said ionized vaporized liquid, to produce within the mass of said quantity a controlled superheating energy.

13. An apparatus according to claim 12, further comprising a transistor and a resistance, wherein in order to limit the current of the energizing pulse, a constant voltage is set on the base of said transistor and said resistance is placed in series with its emitter, a value of said resistance is chosen so that the current appearing at the collector and which corresponds to the quotient of the voltage of the emitter by this resistance, does not exceed a predetermined value.

14. An apparatus according to claim 13, wherein the base of the transistor is connected between two resistances in series connecting the two terminals of the pulse source, and further comprising a Zener diode disposed in parallel with the resistance, which is connected between the base of the transistor and the negative terminal of said source.

15. An apparatus according to claim 13, further comprising a plurality of said first electrodes disposed in the electrically conductive liquid and a common source for energizing these electrodes by high voltage pulses; and a selection transistor provided for current limitation with said common source to produce control signals at the base.

16. An apparatus according to claim 15, further comprising an electrically conductive membrane, disposed opposite the respective ends of said first electrodes disposed in the electrically conductive liquid, said membrane having an opening opposite each of said ends, and said membrane is connected to one of the terminals of said pulse generator.

17. An apparatus according to claim 13, further comprising a plurality of said first electrodes in the electrically conductive liquid; a transformer, having a secondary energizing, with high voltage pulses, each said first electrode; a selection transistor, provided in series with a primary of said transformer, on the base of which control signals are caused to appear, and each of said transistors being provided for current limitation.

18. An apparatus according to claim 17, further comprising an electrically conductive membrane, disposed opposite the respective ends of said first electrodes disposed in the electrically conductive liquid, said membrane having an opening opposite each of said ends, and said membrane is connected to one of the terminals of said pulse generator.

19. An apparatus according to claim 12, further comprising a capacitor disposed between the first and the second electrodes in order to limit the energy of the energizing pule, a discharge of this capacitor being controlled by a transistor whose conduction threshold is fixed above the ionization voltage of said vapor and the charging of the capacitor is controlled by a resistance.

20. An apparatus according to claim 12 further comprising an inductance placed in series with a transistor disposed between the two electrodes in order to limit the energy of the energizing pulse, said transistor being closed to charge the inductance between energizing pulses, then, at the moment of a pulse, said transistor is cut-off to increase the voltage at the output of the inductance to a value greater than the ionization voltage of said quantity of vaporized liquid, permitting the current to re-establish itself and the inductance to discharge.

* * * * *